US006178792B1

(12) United States Patent
Glazier

(10) Patent No.: US 6,178,792 B1
(45) Date of Patent: Jan. 30, 2001

(54) KEY RETAINING LOCK APPARATUS

(76) Inventor: James F. Glazier, 4308 42 Ave., #20, Rocky Mountain House, Alberta (CA), T0M 1T1

( * ) Notice: Under 35 U.S.C. 154(b), the term of this patent shall be extended for 0 days.

(21) Appl. No.: 09/220,837

(22) Filed: Dec. 24, 1998

(51) Int. Cl.[7] ..... E05B 11/00
(52) U.S. Cl. ..... 70/389; 70/421; 70/429; 70/DIG. 63
(58) Field of Search ..... 70/389, 390, 421, 70/429, 441, DIG. 63

(56) References Cited

U.S. PATENT DOCUMENTS

| | | | | |
|---|---|---|---|---|
| 2,220,786 | * | 11/1940 | Grainger | 70/389 X |
| 3,203,210 | * | 8/1965 | Check et al. | 70/DIG. 63 X |
| 3,791,180 | * | 2/1974 | Doyle | 70/DIG. 63 X |
| 4,315,420 | * | 2/1982 | Oliver | 70/389 X |
| 4,567,741 | * | 2/1986 | Trempala | 70/389 |
| 4,641,507 | * | 2/1987 | Demonbreun | 70/DIG. 63 X |
| 4,641,509 | * | 2/1987 | Batchelor et al. | 70/389 X |
| 4,712,400 | * | 12/1987 | Steinbach | 70/421 X |
| 5,372,021 | * | 12/1994 | Smith | 70/DIG. 63 X |
| 5,505,066 | * | 4/1996 | Baucom | 70/389 |

* cited by examiner

*Primary Examiner*—Lloyd A. Gall
(74) *Attorney, Agent, or Firm*—G. F. Gallinger

(57) ABSTRACT

An apparatus having two barrel and tumbler locks which are longitudinally overlapped and conjoined to operate in combination with each other. When the first lock is moved to an open position it becomes frozen with the key snagged therein. The second lock is used to unfreeze and release the key from the first lock. Both locks are of the type having a barrel and tumbler. The first lock has a barrel having a ramped circumferential groove segment having a shallow end portion. A groove wafer extends from the tumbler into this groove. The second release lock has a circumferential groove segment in its barrel similarly having a groove wafer extending from the tumbler into this groove. The groove segments are arranged so that the shallow end portion of the first ramped groove segment meets an end portion of the groove on the second lock so that when the first lock is rotated from a closed position to an open position its groove wafer moves from the ramped groove downwardly into the groove segment in the second barrel, thereby preventing the barrel from being rotated back to an open position to release its key. The first lock may only be released when the groove wafer in the second lock is used to push the first groove wafer out of the groove segment in the second barrel.

6 Claims, 1 Drawing Sheet

KEY RETAINING LOCK APPARATUS

FIELD OF INVENTION

This invention relates to locks which retain the keys which open them. More particularly invention relates to an apparatus having two barrel and tumbler locks which operate in combination with each other. When the first lock is moved to an open position it becomes frozen with the key snagged therein. The second lock is used to unfreeze and release the key from the first lock.

BACKGROUND OF THE INVENTION

National and provincial government parks in Canada currently supply fire wood at no additional cost to campers when it is available from trees that have been removed. The provision of free firewood is being abused. Park managers believe that one half of the firewood provided to campers is either stolen or wasted. Another problem is that during wet periods—when firewood is most needed—all of the wood available is too wet to readily burn.

OBJECTS AND STATEMENT OF INVENTION

It is an object of this invention to disclose a lock apparatus which will freeze in an open (or closed) position and retain the key therein. It is an object of this invention to disclose a lock apparatus which may be used in a dispensing box so that the key to the dispensing box may be delivered to the buyer at the time of sale. More specifically it is an object of this invention to facilitate the sale of dry fire wood in parks. When the sale of wood is made the key to a full box of wood will be delivered to the buyer. Upon use, the key will be snagged in the lock and the lock will be frozen open. It is yet a further object of this invention to stop theft and promote the judicious use of fire wood through a convenient vending apparatus which will facilitate sales therefrom. It is a final object of this invention to disclose a key retaining lock which may be used to facilitate and monitor the vending of particularly difficult to handle products delivered to the point of use.

One aspect of this invention provides for a key retaining lock apparatus comprising a first snag lock and a releasing lock. The first snag lock has a barrel having an interior longitudinal slot, and a ramped circumferential groove segment having a shallow and deep end portion; a tumbler within the barrel; a key; a radial catch arm connected to a rear portion of the tumbler; locking wafers in the tumbler slidingly projecting into the longitudinal slot which are fully retracted when the key is fully inserted into the tumbler so that the tumbler may be rotated turning the catch arm; and, an outwardly biased groove wafer in the tumbler slidingly projecting into the ramped circumferential groove segment in the first barrel. The second releasing lock has a barrel having an interior longitudinal slot, and a circumferential groove segment; a tumbler within the barrel; a key; locking wafers in the tumbler slidingly extending into the longitudinal slot which are fully retracted when the key is fully inserted into the tumbler so that the tumbler may be rotated; and, a strongly outwardly biased sliding groove wafer in the tumbler slidingly projecting into the circumferential groove segment in the second barrel. The barrels of the two locks are longitudinally overlapped and conjoined, and the circumferential groove segments are positioned and aligned so that the shallow end portion of the first ramped groove segment meets an end portion of the groove on the second lock so that when the first lock is rotated from a closed position to an open position its groove wafer moves from the deep end portion of the ramped groove, through the shallow end portion thereof, and finally upon meeting the circumferential groove segment in the second barrel, it jumps downwardly thereinto, freezing and preventing the barrel from being rotated back to an open position. In the open position the locking wafers are not aligned with the longitudinal interior slot in the barrel and therefor hold the key in the first snag lock. The second releasing lock which initially is in a non releasing position, may be rotated to a releasing position after its key is fully inserted, retracting the locking wafers from the longitudinal slot, so that its stronger downwardly biased groove wafer travels from a first end portion of its circumferential groove segment to an opposite end portion thereof where it contacts with the first lock groove wafer, pushing it inwardly to a retracted position so that the barrel of the first key snag lock may be located back to a closed position and the first key may be removed from the key snag lock barrel.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
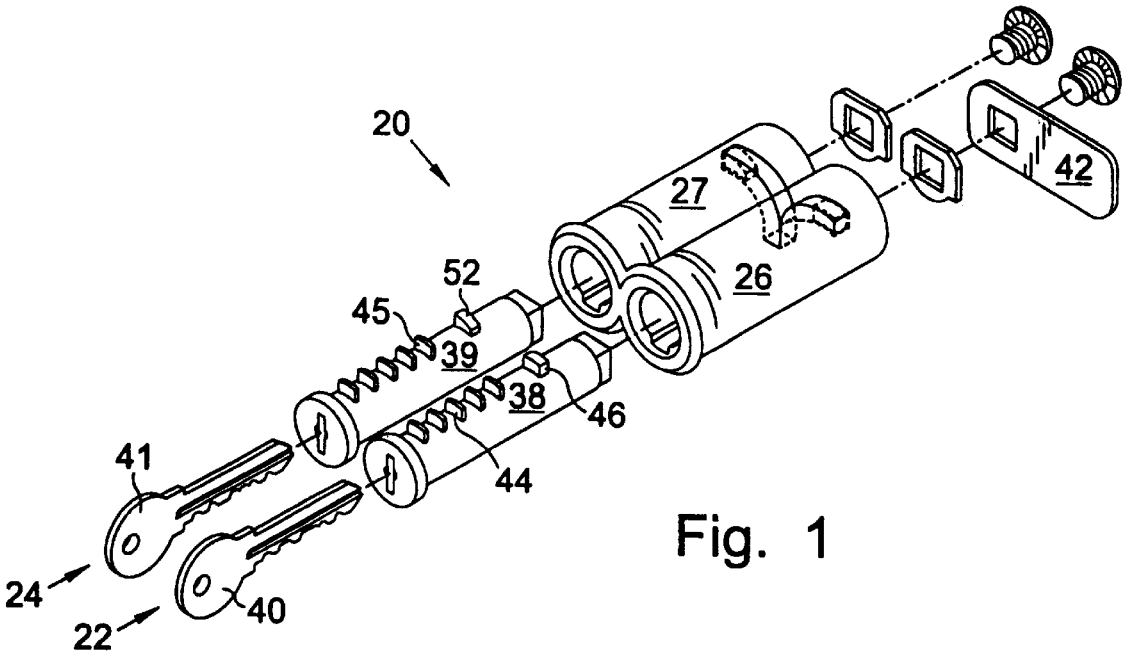
FIG. 1 is an exploded perspective view of a key retaining lock apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
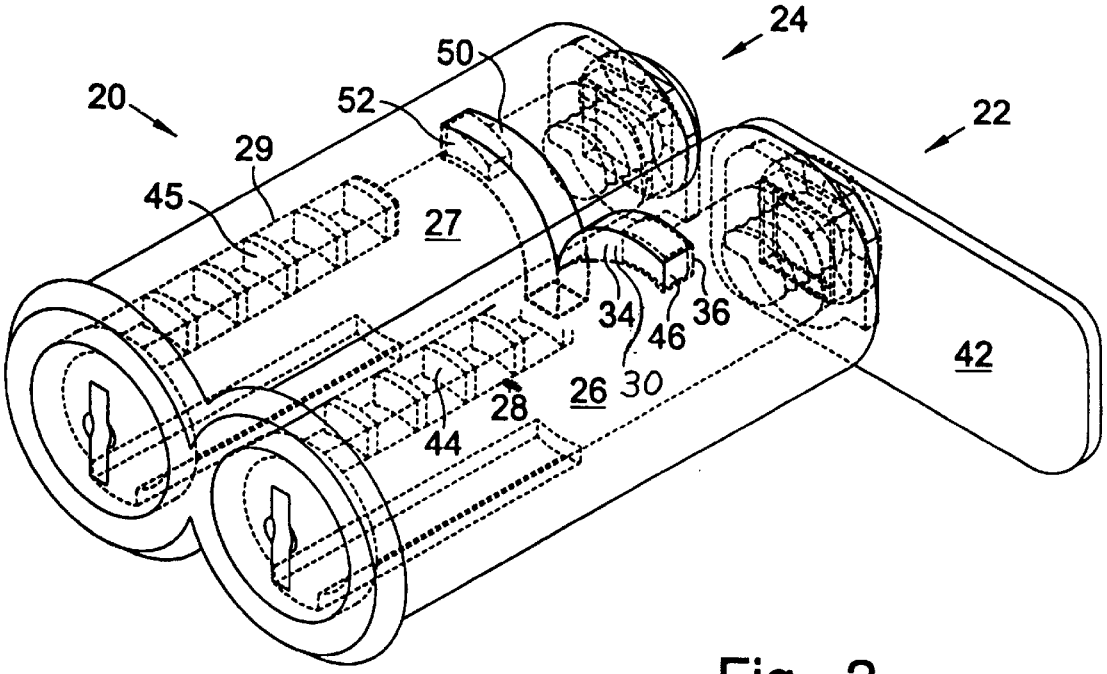
FIG. 2 is an assembled view of the portion of the key retaining lock apparatus which would be mounted in a swinging door.

Turning now to the drawings and more particularly to FIG. 1 we have an exploded perspective view of a key retaining lock apparatus 20. FIG. 2 is an assembled view of the portion of the key retaining lock apparatus 20 which would be mounted in a swinging door (not shown). The key retaining lock apparatus 20 comprises two locks, a first key snag lock 22 which is used to open a door (not shown), and a second release lock 24, which is used to release the key snag lock 22. The first key snag lock has a barrel 26 having an interior longitudinal slot 28, and a ramped circumferential groove segment 30 having a shallow 34 and deep end portion 36; a tumbler 38 within the barrel 26; a key 40; a radial catch arm 42 connected to a rear portion of the tumbler 38; locking wafers 44 in the tumbler 38 slidingly projecting into the longitudinal slot 28 which are fully retracted when the key 40 is fully inserted into the tumbler 38 so that the tumbler 38 may be rotated turning the catch arm 42; and, an outwardly biased groove wafer 46 in the tumbler 38 slidingly projecting into the ramped circumferential groove segment 30 in the first barrel 26.

The second releasing lock 24 has a barrel 27 having an interior longitudinal slot 29, and a circumferential groove segment 50; a tumbler 39 within the barrel 27; a key 41; locking wafers 45 in the tumbler 39 slidingly extending into the longitudinal slot 29 which are fully retracted when the key 41 is fully inserted into the tumbler 39 so that the tumbler 39 may be rotated; and, a strongly outwardly biased sliding groove wafer 52 in the tumbler 39 slidingly projecting into the circumferential groove segment 50 in the second barrel 27.

The barrels 26,27 are longitudinally overlapped and conjoined. The circumferential groove segments 30,50 are positioned and aligned so that the shallow end portion 34 of the first circumferential ramped groove segment 30 meets an end portion of the circumferential groove segment 50 on the second lock 24 so that when the first barrel 38 is rotated from a closed position to an open position its groove wafer 46 moves from the deep end portion 36 of the circumferential ramped groove segment 30, through the shallow end portion 34 thereof, and finally upon meeting the circumferential groove segment 50 in the second barrel 27, it jumps downwardly thereinto, freezing and preventing the first barrel 38 from being rotated back to the closed position.

When the first lock 22 is in an open position the locking wafers 44 are not aligned with the longitudinal interior slot 28 in the barrel 26 and therefor the key 40 is held in the first snag lock 22.

The second releasing lock 24 which initially is in a non-releasing position, may be rotated to a releasing position after its key 41 is fully inserted, retracting the locking wafers 45 from the longitudinal slot 29, so that its downwardly biased groove wafer 52 travels from a first end portion of its circumferential groove segment 50 to an opposite end portion thereof where it contacts with the first lock groove wafer 46, pushing it inwardly to a retracted position so that the barrel 38 of the first key snag lock 22 may be rotated back to a closed position and wherein the first key 40 may be removed from the snag lock barrel 38. It should be noted that the groove wafer 52 on the release lock 24 has a stronger outward bias, than the groove wafer 46 on the first snag lock 22.

In the most preferred embodiment the groove wafers 46,52 are generally double the thickness of the locking wafers 44,45. There is one groove wafer 46 or 52, and five locking wafers 44,45 on each lock 22 or 24. The groove wafers 46,52 are positioned behind the locking wafers 44,45 on the barrels 26,27. Most preferably the circumferential groove segments 30,50 are positioned on a top portion of the lock barrels 26,27 so that the snag lock 22 is rotated clockwise to lock, and the release lock 24 is rotated clockwise to release. Most preferably an end portion of the groove wafer 52 on the release lock 24 is sloped to facilitate pushing the snag lock groove wafer 46 from the circumferential groove segment 50 in the barrel 27 of the release lock 24.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A key retaining lock apparatus comprising:

a first snag lock having a barrel having an interior longitudinal slot, and a ramped circumferential groove segment having a shallow and deep end portion;

a tumbler within the barrel;

a key;

a radial catch arm connected to a rear portion of the tumbler;

locking wafers in the tumbler slidingly projecting into the longitudinal slot which are fully retracted when the key is fully inserted into the tumbler so that the tumbler may be rotated turning the catch arm; and, an outwardly biased groove wafer in the tumbler slidingly projecting into the ramped circumferential groove segment in the first barrel; and, a second releasing lock having a barrel having an interior longitudinal slot, and a circumferential groove segment;

a tumbler within the barrel;

a key;

locking wafers in the tumbler slidingly extending into the longitudinal slot which are fully retracted when the key is fully inserted into the tumbler so that the tumbler may be rotated; and, a strongly outward biased sliding groove wafer in the tumbler slidingly projecting into the circumferential groove segment in the second barrel;

said barrels being longitudinally overlapped and conjoined, and said circumferential groove segments being positioned and aligned so that the shallow end portion of the first ramped groove segment meets an end portion of the groove segment on the second lock so that when the first barrel is rotated from a closed position to an open position its groove wafer moves from the deep end portion of the ramped groove segment, through the shallow end portion thereof, and finally upon meeting the circumferential groove segment in the second barrel, it jumps downwardly thereinto, freezing and preventing the first barrel from being rotated back to the closed position;

where in said open position said locking wafers of said first lock are not aligned with the longitudinal interior slot in the first barrel and therefor hold the key in the first snag lock; and wherein, the second releasing lock which initially is in a non releasing position, may be rotated to a releasing position after its key is fully inserted, retracting the locking wafers from the longitudinal slot, so that its strongly outward biased groove wafer travels from a first end portion of its circumferential groove segment to an opposite end portion thereof where it contacts with the first lock groove wafer, pushing it inwardly to a retracted position so that the barrel of the first key snag lock may be located back to a closed position and wherein the first key may be removed from the key snag lock barrel.

2. An apparatus as in claim 1 wherein the groove wafers are substantially thicker than the locking wafers.

3. An apparatus as in claim 2 wherein the groove wafers are generally double the thickness of the locking wafers.

4. An apparatus as in claim 3 wherein the groove wafers are positioned behind the locking wafers on the barrel.

5. An apparatus as in claim 4 wherein the circumferential groove segments are positioned on a top portion of the lock barrels so that the snag lock is rotated clockwise to lock, and the releasing lock is rotated clockwise to release.

6. An apparatus as in claim 5 wherein an end portion of the groove wafer on the releasing lock is sloped to facilitate pushing the snag lock groove wafer from the circumferential groove segment in the barrel of the releasing lock.

* * * * *